US009677230B2

(12) United States Patent
Terstriep

(10) Patent No.: US 9,677,230 B2
(45) Date of Patent: Jun. 13, 2017

(54) WIDE SWATH OFFSET CONCRETE SCREED

(71) Applicant: Luke Terstriep, Quincy, IL (US)

(72) Inventor: Luke Terstriep, Quincy, IL (US)

( * ) Notice: Subject to any disclaimer, the term of this patent is extended or adjusted under 35 U.S.C. 154(b) by 0 days.

(21) Appl. No.: 14/877,805

(22) Filed: Oct. 7, 2015

(65) Prior Publication Data

US 2017/0101745 A1 Apr. 13, 2017

(51) Int. Cl.
*E01C 19/42* (2006.01)

(52) U.S. Cl.
CPC ..... *E01C 19/42* (2013.01)

(58) Field of Classification Search
CPC ..... E01C 19/42
USPC ..... 404/83, 55, 86, 89, 93, 94, 75
See application file for complete search history.

(56) References Cited

U.S. PATENT DOCUMENTS 1,571,094 A * 1/1926 Perkins ..... A01D 67/005 280/409
3,669,394 A * 6/1972 Loucks ..... E04F 21/05 248/218.4
4,215,495 A * 8/1980 Wagner ..... E02F 3/841 172/239
4,256,416 A * 3/1981 Bishop ..... E04G 21/10 404/119
5,671,553 A * 9/1997 Burkhart ..... E01C 23/082 172/372
5,860,764 A * 1/1999 Roberts ..... E01C 23/0993 404/124
6,612,774 B1 * 9/2003 Dulin ..... E01C 19/266 404/104
6,728,994 B1 * 5/2004 Rushin, Jr. ..... E04F 21/241 16/422
6,739,612 B2 * 5/2004 Colistro ..... A01B 59/042 172/313
7,491,013 B2 * 2/2009 Bohse ..... E01C 19/44 404/118
7,789,587 B2 * 9/2010 James ..... E01H 1/003 172/172
D666,467 S * 9/2012 Salotto ..... D8/45
8,297,879 B1 * 10/2012 Schmidt ..... E01H 1/003 172/811
2009/0092444 A1 * 4/2009 Schoen ..... E01C 19/405 404/118

* cited by examiner

*Primary Examiner* — Raymond W Addie
(74) *Attorney, Agent, or Firm* — Brevetto Law Group

(57) ABSTRACT

Methods and systems for making and using a wide swath offset concrete screed apparatus for screeding wet concrete slurry. The apparatus includes a cross support bar, an attachment mechanism for attaching the cross support bar to a liftable arm of a motorized vehicle, and lateral support bars for attaching a screed bar to the cross support bar. The screed bar is positioned offset from the motorized vehicle used to operate the screed, allowing the motorized vehicle to drive outside the forms.

17 Claims, 8 Drawing Sheets

WIDE SWATH OFFSET CONCRETE SCREED

BACKGROUND

Field of the Invention

The present invention relates to a wide swath offset concrete screed for leveling poured concrete within a form, and more specifically systems and methods of making and using a wide swath concrete screed that doesn't require mechanical vibration.

Description of Related Art

Wet concrete generally arrives on-site in a concrete truck for pouring into the forms to define the desired level when the concrete dries. When the concrete is poured from the chute of the concrete truck the result is generally mounds of wet concrete—often called mud or slurry—piled above the level defined by the top edges of the forms. The slurry must be promptly leveled as it is poured, before it hardens or sets. Typically, the leveling is performed by a screed—a specialized tool that traverses the forms. Smaller pours such as a sidewalk can be leveled with a hand screed that one or more workers drag along the forms to level the mounds of wet concrete. It is not feasible to use hand screeds for larger pours such as parking lots, road surfaces, the floors of buildings or other such large, flat concrete surfaces. The weight of the concrete being pulled off is generally too great for workers to use hand screeds.

Larger concrete projects must be poured in strips that may be ten to twenty feet wide, but can even be thirty or more feet wide. Conventional mechanized concrete screeds are used to level the strips of concrete. One such type of conventional mechanized screed involves the use of a vibrating screed. A small gasoline engine is mounted on the screed with a rotating offset weight designed to impart vibration to the screed as it is dragged across the wet mud. Some conventional vibrating screed implementations require one or more workers just outside the forms to push and guide the screed along the top of the forms as the engine vibrates the screed. The vibration is required to prevent small pebbles from momentarily catching on the front edge of the screed and dragging small holes in the surface of the slurry before the pebble finally passes under the screed. The vibration aids in pushing the small pebbles down into the slurry, allowing the conventional vibrating screed to pass over the pebbles with minimal perturbation to the surface of the wet concrete. A gasoline or diesel engine is required for this conventional solution, thus requiring one or more workers to attend to the engine as the device is started and stopped many times during the course of a day's pouring. Due to the dirt and dust present at the work site it can be difficult to keep the conventional vibrating screed from breaking down during a pour, often necessitating emergency repairs to keep pouring while concrete trucks are standing by ready to unload their wet concrete.

Published U.S. Patent Application 2009/0092444A1 to Schoen (hereinafter "Schoen") describes a conventional wide swath motorized screeds. The Schoen screed features a screed mechanism attached to a skid loader that a worker operates to pull the mounds of wet concrete and create a level surface. Another implementation of a conventional mechanical screed involves attaching a conventional vibrating screed to a front end loader or skid loader. Mounting a conventional vibrating screed on a front end loader eliminates the need for concrete workers to push the screed along as it vibrates.

SUMMARY

Embodiments disclosed herein address drawbacks of the conventional mechanical concrete screeds. The presently disclosed embodiments save considerable labor in the process or leveling wet concrete. For example, a conventional screed device requires a crew of six or more workers to pour and finish the concrete surface. Using the various embodiments disclosed herein a similarly sized pour of concrete could easily be handled by three workers—a savings of at least 50% in labor costs.

Various embodiment disclosed herein provide methods and systems for making and using a wide swath offset concrete screed apparatus for screeding wet concrete slurry. The apparatus includes a cross support bar, an attachment mechanism for attaching the cross support bar to a liftable arm of a motorized vehicle, and lateral support bars for attaching a screed bar to the cross support bar. The screed bar is positioned offset from the motorized vehicle used to operate the screed, allowing the motorized vehicle to drive outside the forms.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. In the drawings.

DETAILED DESCRIPTION

Figure 1:
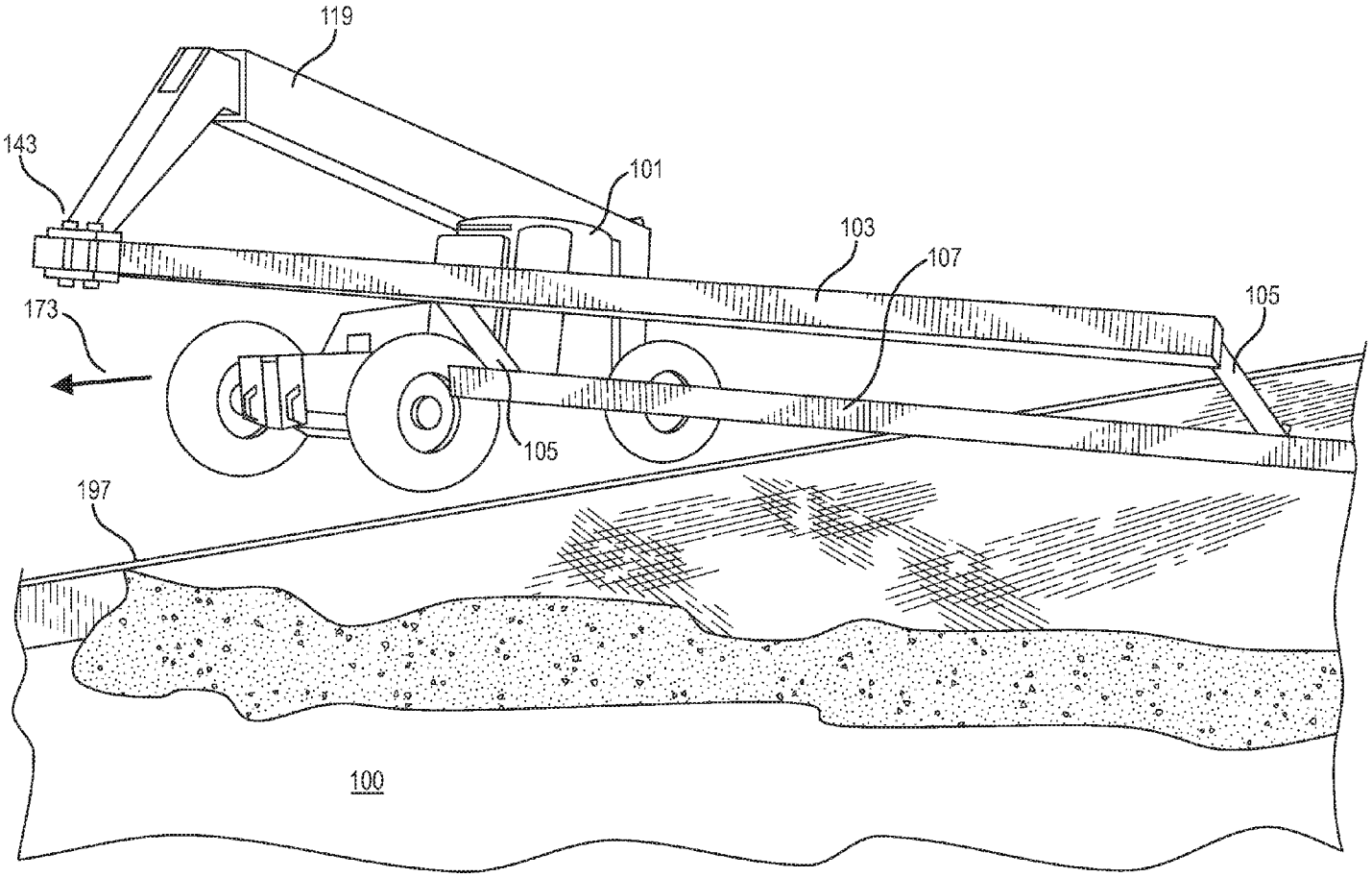
FIG. 1 is an oblique view of a wide swath offset concrete screed according to various embodiments disclosed herein.

Typically, to pour a swath of concrete a pair of longitudinal forms is assembled at the desired level of the concrete. The longitudinal forms run along the sides of the swath, and an end form may be positioned between the longitudinal forms, defining the end of the swath. Once the wet concrete slurry is poured within the longitudinal forms—generally, one truckload at a time—the leveling is performed by running a screed along the top of the longitudinal forms to smooth the swath of concrete between the forms. The term "leveling" is used to describe the smoothing process using a screed. The result of "leveling" the wet concrete slurry with a screed produces a relatively flat surface between the forms. This flat concrete surface that results from leveling with a screed may, or may not, be level with respect to the earth's surface. For example, the floors of buildings, parking lots and other concrete surfaces are often designed to have a slight degree of slope in order to allow water to run off. Concrete surfaces are often poured to slope between ⅛ inch per foot to up to ⅝ inch per foot, with ¼ inch per foot being a common value. Therefore, the term "leveling" as it is used herein implies that the surface of the concrete is smoothed to conform to a flat surface between the top edges of the forms, and may include a built in amount of slope rather than being perfectly level relative to the earth's surface. That is, leveling wet concrete means to smooth the surface to be relatively flat across the tops of the two forms the concrete was poured into. In situations where multiple swaths are being poured to form a wide expanse of concrete, it is often the case that the previously poured swath of concrete, now hardened, is used in place of the forms on one side of the next swath to be poured. In such cases where a swath is being poured beside another, previously poured swatch, a spacer may be used to compensate for the level of freshly screeded concrete being slightly lower than the level of the underside of the screed, as discussed further in conjunction with FIG. 5.

Motorized screeds—that is, a screed mechanism attached to a skid loader or other motorized vehicle—are often used to save time and labor in pouring swaths of concrete. The present inventor recognized several drawbacks inherent in the designs of conventional mechanized screeds, for example, the Schoen screed of Published U.S. Patent Application 20090092444A1. One major drawback of it is that the front end loader of the conventional Schoen screed must be driven within the forms directly ahead of the wet concrete being leveled. Nearly all concrete is poured over one or more layers of iron rebar lying on a surface of sand which acts to strengthen and reinforce the concrete. Using the conventional Schoen motorized screed requires the skid loader to be driven over the rebar, pushing it into the layer of sand beneath the concrete and often causing deformities in the rebar. This would render the rebar useless unless remedied before the concrete dries. Thus, workers must be positioned between the conventional Schoen screed and the wet concrete being leveled to pull the rebar out of the sand. Another disadvantage of the Schoen device that the present inventor recognized involves the end form for the pour. An end form is the form at the end of the swath being poured, for example, to define the edge of a building pad or parking lot. A skid loader cannot be driven over the end form without destroying it. So, in order to use the Schoen device the end form must be assembled as soon as the front end loader of the conventional Schoen screed passes that point. Alternatively, some sort of makeshift removable bridge or ramps could be constructed over the end form, allowing the front end loader of the conventional Schoen screed to be driven up over the end forms without damaging them. These, and other drawbacks of the conventional screeds recognized by the present inventor, are overcome by various embodiments disclosed herein.

FIG. 1 is an oblique view of a wide swath offset concrete screed 100 according to various embodiments disclosed herein. The wide swath concrete screed is mounted on a motorized vehicle 101 such as a skid loader, an extension loader, a front end loader, a tractor, a backhoe, a truck, a tractor, a tracked loader, or other such motorized vehicle. The wheeled vehicle 101 has a liftable mechanical arm 119 of sufficient strength to hold the screed assembly with the capability of lifting it up and down. The offset wide swath concrete screed 100 affords the advantage of being mounted to the side of motorized vehicle 101—that is, the concrete screed 100 is mounted such that the screed bar 107 is offset to the side of the motorized vehicle 101. To be considered "offset" the screed bar 107 must be positioned outside the wheels (or track, if a tracked vehicle) in the direction of an axle of the motorized vehicle 101. This offset mounting configuration allows the motorized vehicle 101 to be driven along the outside of concrete forms 197. This is a significant advantage over conventional mechanized screeds that drive within the concrete forms. In this way the various embodiments disclosed herein do not push the rebar 199 into the sand as the concrete is being screeded. Moreover, the various embodiments of the wide swath concrete screed disclosed herein are able to screed concrete right to the end of the longitudinal forms without damaging the end form. Various embodiments of screeds disclosed herein are also capable of being mounted directly in front of the motorized vehicle 101 for those situations when there is insufficient room alongside the forms 197 to drive the motorized vehicle 101, e.g., when the last swath being poured is up against a fence, wall or building.

The liftable arm 119 of the motorized vehicle 101 allows a user to lift the concrete screed 100 up and down as needed during the pour. Since the concrete screed 100 may weigh 300 pounds or more, with an outer end that extends beyond the motorized vehicle 101 by several feet more the width of the longitudinal forms, the liftable arm 119 must have sufficient strength to withstand the rotational force due to the weight of the concrete screed 100 hanging out to the side.

The offset concrete screed 100 includes a connection mechanism 143 or structure for attaching the cross support bar 103 to the motorized vehicle 101. In some embodiments the connection mechanism 143 includes two metal plates bolted together to clamp down on the cross support bar 103 and hold it securely to the liftable arm 119. In some embodiments the connection mechanism 143 includes U-bolts, or metal cables, to secure the cross support bar 103 to the liftable arm 119. In other embodiments the connection mechanism 143 includes an adapter to fasten the cross support bar 103 to a fork lift attachment, or a three-point hitch, of the liftable arm 119. In yet other embodiments the connection mechanism 143 attaches to a hydraulic cylinder to affix the cross support bar 103 to the motorized vehicle 101. Regardless of the configuration, the various embodiments of the connection mechanism 143 includes structural means for attaching the cross support bar 103 to the liftable arm 119 of the motorized vehicle 101, either in a stationary position or in a manner capable of hinging.

A screed bar 107 is configured to pull the mounds of wet concrete slurry deposited within the forms by a concrete truck. In this way the slurry is leveled during a pour by the action of the motorized vehicle driving back and forth on the outside of forms 197. The screed bar 107 is pulled by lateral support bars 105, which in turn, are connected to cross support bar 103. The motorized vehicle 101 may be positioned to push the cross support bar 103 in the direction of screeding movement 173, as shown in FIG. 1. Alternatively, the motorized vehicle 101 may be positioned on the other side of the cross support bar 103 so as to pull the cross support bar 103 in the direction of movement 173. In either case, the screed bar 107 is dragged behind the cross support bar 103 as the wet concrete slurry is being screeded. This dragging motion prevents the screed bar 107 from jamming down or catching on the forms as it is moved along.

The screed bar 107 is of sufficient length for both ends to rest on the longitudinal forms 197. Typically the screed bar 107 is slightly wider than the distance between the longitudinal forms 197 so that the screed bar 107 extends beyond the longitudinal forms 197 by a few inches. In a typical implementation the screed bar 107 may be from 6 to 24 inches longer than the distance between the longitudinal forms 197. In other implementations the screed bar 107 may be any length from the same width as the outer width of the forms up to ten or more feet wider than the width of the forms. There is no set limit as to how much wider the screed bar 107 is as compared to the width of the forms 197. However, since workers often walk or stand just outside the forms it tends to be more safe and convenient for the width of the screed bar 107 to extend beyond the forms by no more than a few inches on each side. For example, in some embodiments the screed bar 107 is of a sufficient length so that it extends beyond the forms by 8-10 inches on either side to keep the screed from falling inside the forms 197.

Depending upon the application, the swatch of concrete may be of any given width. For some uses the width of the concrete swath is not important. For example, a large expanse of concrete such as a parking lot may sometimes be poured in strips or swaths of any width, up to the maximum width, that is desired by the prime contractor or suitable for the situation. However, some applications (and some builders) require that the concrete be poured in a specific width swatch, e.g., 12 feet, 15 feet, 20 feet, 25 feet, 30 feet, or other such swath widths. To accommodate these specific swath widths, the concrete screed 100 may be equipped with various lengths of screed bar 107. In some embodiments, the length of the screed bar 107 is fixed, and bars of various lengths are swapped out to accommodate the required swath width. Other embodiments of the screed bar 107 are configured so that the length of the screed bar 107 may be adjusted to suit the distance between the forms 197 or other parameters. This may be achieved by providing a telescoping screed bar 107, or by providing removable sections of the screed bar 107 which may be swapped out to achieve the desired length.

The screed bar 107 is held by two or more lateral support bars 105, which in turn, are connected to a cross support bar 103. To smooth out the mounds of wet concrete the motorized vehicle 101 is typically positioned to push the cross support bar 103. However, the cross support bar 103 is configured to pull the screed bar 107 along, dragging the wet concrete to a level format. This pulling action aids in preventing the screed bar 107 from gouging into the longitudinal forms, thus making the screed bar 107 operate more smoothly as the wet concrete is being leveled.

Figure 2:
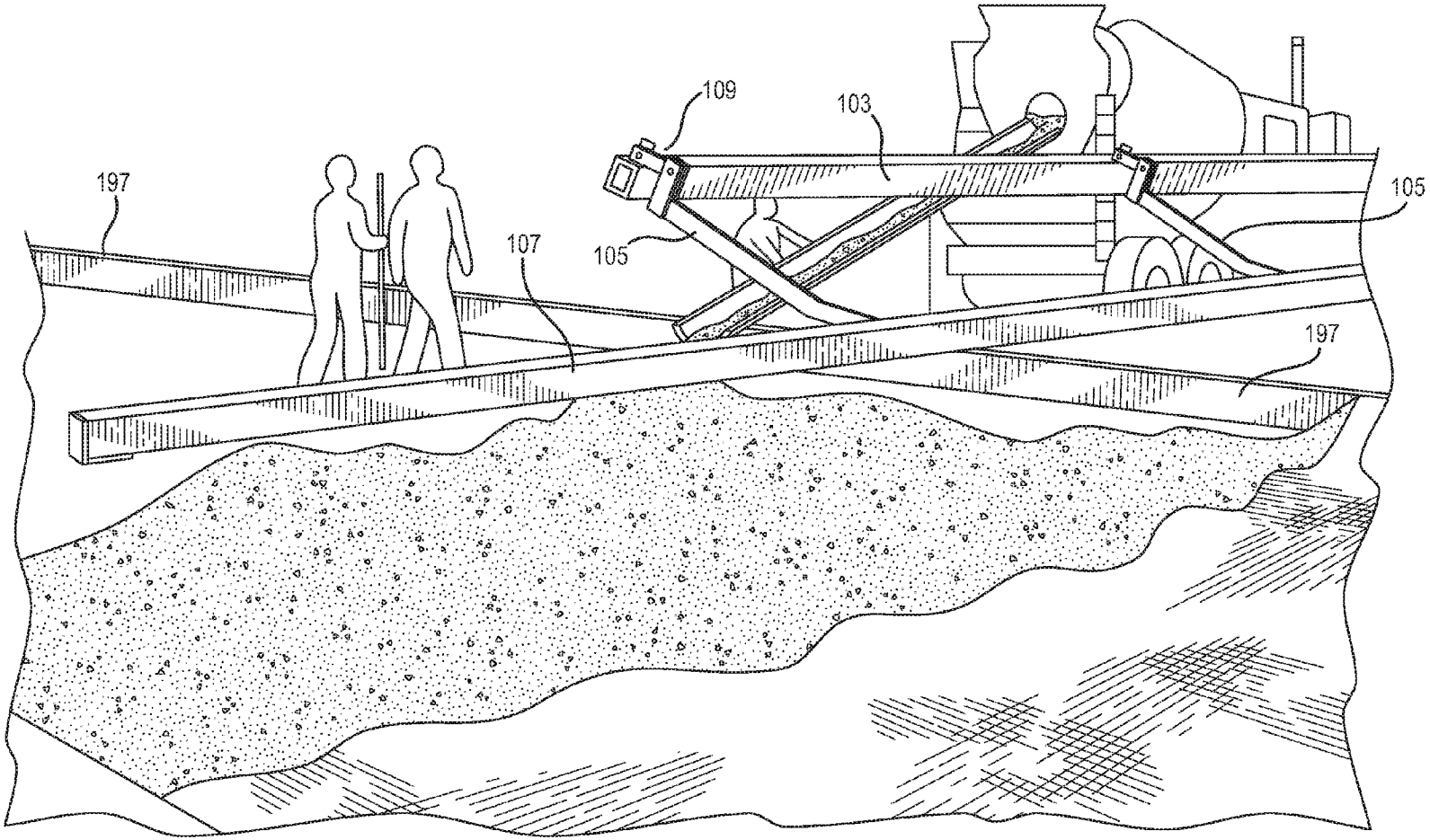
FIG. 2 is an oblique view depicting wide swath offset concrete screed in use as wet concrete is being poured.

FIG. 2 is an oblique view depicting wide swath offset concrete screed 100 in use as wet concrete is being poured. The figure shows the point in time when the wet concrete from one truck has already been leveled out, the screed bar 107 has been lifted up out of the way, and motorized vehicle of 101 (not shown) of the concrete screed 100 is backed up so as to allow another truckload of wet concrete to be poured.

As shown in FIG. 2 the lateral support bar 105 is attached to the cross support bar 103 by a hinge assembly 109 configured to hinge upward as the screed bar 107 comes to rest on forms 197. The hinge assembly 109 prevents the screed bar 107 from hinging downward more than a predetermined amount, in order to lift the screed bar 107 off the forms as shown in FIG. 2. The predetermined amount—defined as the support bar angle—is measured at the point where the motorized vehicle 101's liftable arm 119 has been lowered such that the screed bar 107 just touches the forms 197. At this point, various embodiments are configured so the lateral support bar 105 hangs downward at a support bar angle of from 3 degrees to as much as 45 degrees, or any angle within these limits, with a hang angle of 15 degrees being typical.

Figure 3:
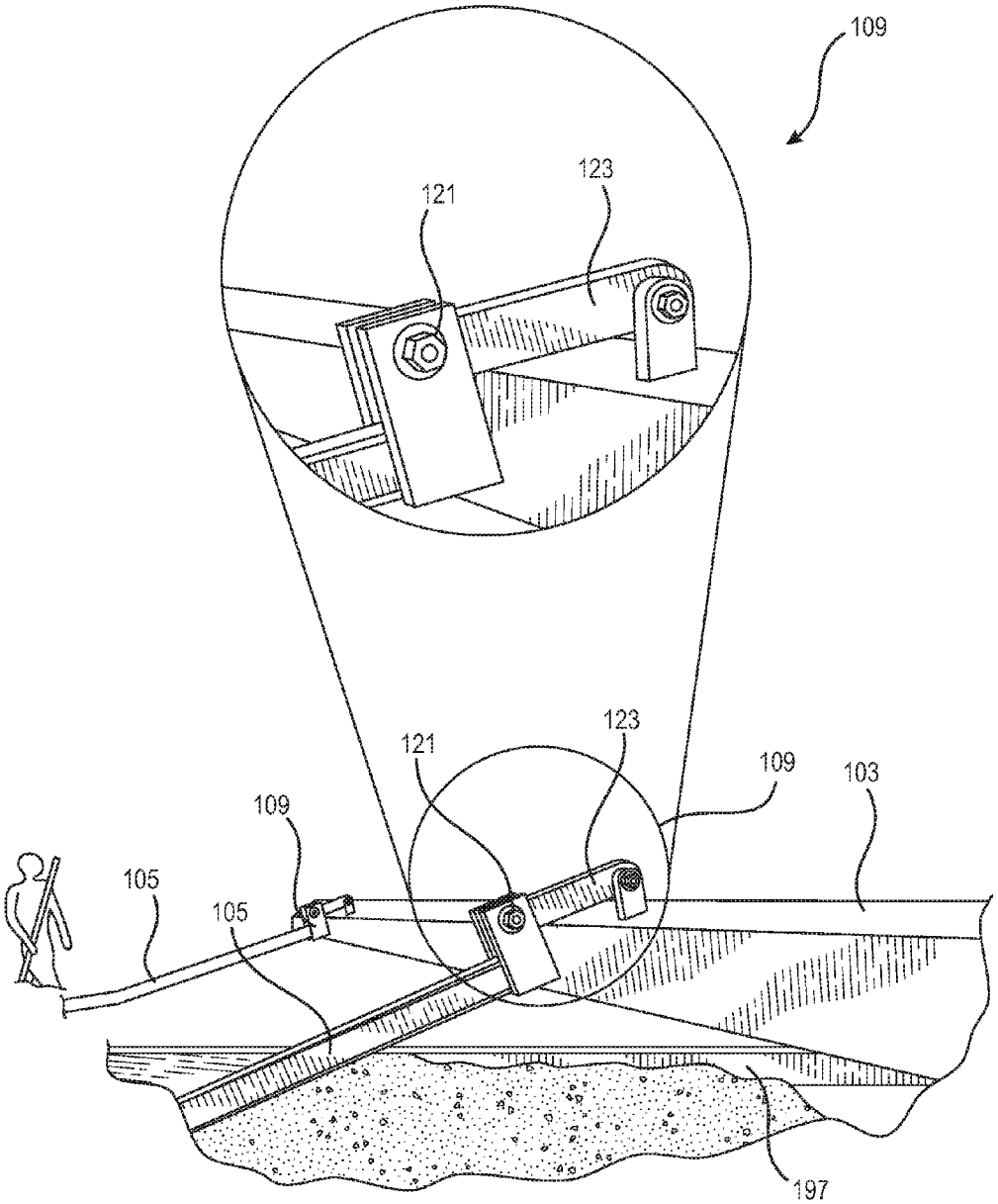
FIG. 3 is a close up view depicting details of the hinge assembly between the lateral support bar and the cross support bar.

FIG. 3 is a close up view depicting details of one embodiment of the hinge assembly 109 between the lateral support bar 105 and the cross support bar 103. Other embodiments may use like types of structures configured to provide a hinging action such as an ordinary hinge, a rocker arm assembly, a trough holding the ends of lateral support bars 105 and flexible cable controlling the maximum hinge angle or support bar angle, a ball joint, or other like types of hinging structures. The hinge assembly 109 connects the lateral support bar 105 to the cross support bar 103. The hinge assembly 109 allows the lateral support bar 105, and in turn the screed bar 107, to hinge upward as the device is lowered onto the longitudinal forms 199. As discussed above, the hinge assemblies 109 prevent the lateral support bars 105, and in turn the cross support bar 103, from hinging downward by more than a predetermined amount, defined as the support bar angle. In this way the motorized vehicle 101 can lift the screed bar 107 up in the air.

The conventional the Schoen screed of Published U.S. Patent Application 20090092444A1 features a mounting pocket 62 that prevents arm 48 from rotating too far downward. Such a pocket/arm assembly could be used with embodiments disclosed herein as a hinging mechanism. However, the present inventor recognized certain drawbacks with the Schoen pocket/arm assembly. Namely, the pocket tends to retain wet concrete and small pebbles during the course of a working day. This, in turn, makes the pocket difficult to clean upon completion of a work day. At the end of each day, and perhaps even during the course of the day, the bar 48 must be rotated upward out of pocket 62 in order to clean out all the accumulated concrete and pebbles. If the pocket 62 of the Schoen device is allowed to dry overnight without being thoroughly cleaned it will sometimes freeze in place as the bits of remaining concrete dry and harden. The Schoen device can also freeze up while it is being used if a small pebble or bit of concrete becomes lodged between the bar 48 and pocket 62. The hinge assembly 109 overcomes these drawbacks since it is a more open design which does not tend to accumulate pebbles and wet concrete. The hinge assembly 109 is easier to clean with a hose and water since there is no pocket for pebbles and wet concrete to gather in during the course of a day.

In various embodiments of the offset concrete screed 100, the hinge assembly 109 is rotatably connected to cross support bar 103 by a pin 121. By "rotatably connected" it is meant that the hinge assembly is connected in a manner that allows it to rotate, or hinge, about an axis. In some implementations the pin 121 passes through, or is otherwise connected to, a pin holder bar 123. In other embodiments the pin 121 is connected directly to the cross support bar 103. The pin 121 may be a bolt of sufficient diameter (e.g., ⅜ to 1 inch) for supporting the weight of the lateral support bars 105 and screed bar 107. The bolt may be kept in place with a nut, or two nuts tightened against each other, and washers to aid in preventing wear on the bolt and hinge assembly 109. In other implementations a hinge pin, a metal rod, or other like type of pin may be used as the pin 121.

The hinge assembly 109 is typically configured so that it comes to rest against cross support bar 103 when the offset concrete screed 100 is raised up in the air. The hinge assembly 109 hinges upward in response to the concrete screed 100 being lowered so that the screed bar 107 rests on forms 197. This allows the screed bar 107 to ride along the top of the forms 197 without damaging the forms. The hinging action also allows the screed bar 107 to ride up over an overly large mound of wet concrete to avoid putting too much horizontal strain on the screed bar 107 and concrete screed 100. If the screed bar 107 rides up over an overly large mound of wet concrete the user can simply raise the offset concrete screed 100 up in the air, back up the motorized vehicle 101, and take one or more additional passes at smoothing the large mound of wet concrete. Since embodiments of the offset concrete screed 100 allow the motorized vehicle 101 to be driven off to the side rather than over the rebar, the user can efficiently make several passes without need to have workers reposition to rebar after each pass, as is required for conventional motorized screed devices.

Figure 4:
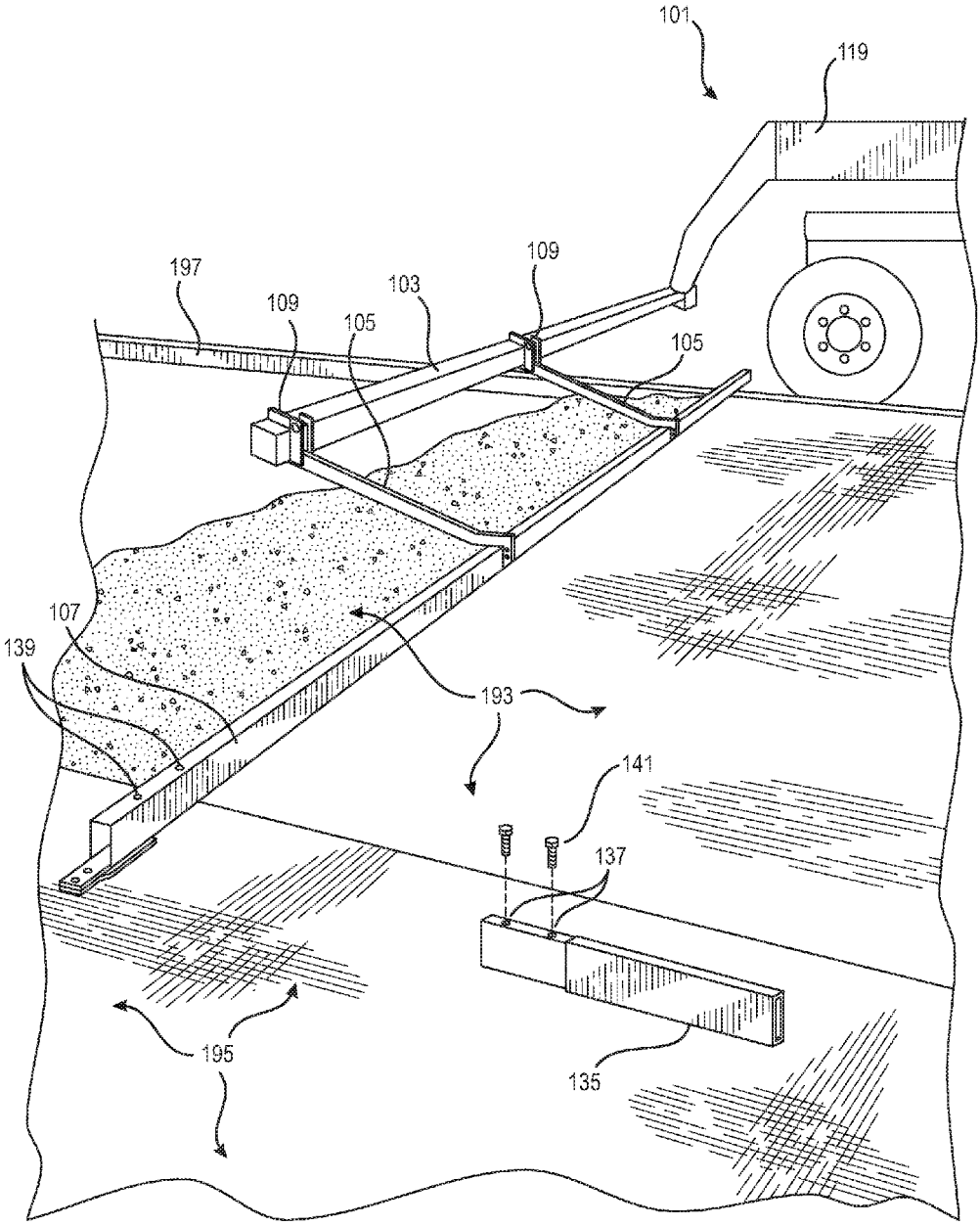
FIG. 4 depicts the wide swath concrete screed being used to level wet concrete using a previously poured swath of concrete in lieu of a form.

FIG. 4 depicts the wide swath concrete screed 100 being used to level the wet concrete slurry 193 using a previously poured swath of concrete 195 in lieu of a form on one side. In pouring large expanses of concrete for a parking lot or building pad it is often the case that the swaths are poured side by side with the previous day's swath acting as a form on one side of the current pour. The very first swath poured requires a form 197 to be set up on each side of the swath to be poured. For each subsequent swath poured after the previous swath has hardened (e.g., a day or more later) only one form 197 needs to be erected. The previously poured swath 195, now hardened, acts as a form on the other side to contain the newly poured wet concrete slurry 193.

One issue with using a previously poured swath in lieu of a form is that the process or screeding wet concrete results in a screeding process delta in which the level of the concrete is slightly lower than the level of the forms (or the form and the previously poured swath being used as a form). For example, a screeded concrete surface may end up ¼ inch or so lower than the forms on either side—that is, have a screeding process delta of ¼ inch or so. This is because the wet concrete slurry contains small pebbles and gravel in it. The screeding process delta results because the screed bar 107 tends to push some of the small pebbles and gravel in front of it, causing the screeded surface of the wet concrete slurry to be slightly lower than the bottom surface of screed bar 107, e.g., ¼ inch or so lower. This can be somewhat troublesome if the concrete is being poured in long swaths alongside a previously poured swath—now hardened—from the previous day. If the screeding process delta was not compensated for and the form 197 was erected to be level with the previously poured swath, each newly poured swath would end up being ¼ inch or so lower than the previously poured swath beside it. If a number of swaths were poured this way the result would be that each swath would be ¼ inch or so lower due to the screeding process delta of each swath. In order to avoid this, it is desirable to provide forms 197 for the new swath to be poured that are at a level slightly higher than the previously poured swath to its side by an amount equal to the anticipated screeding process delta. The slightly higher level of the form 197 compensates for the lower level of finished concrete due to the screed bar 107 pushing small pebbles and gravel in front of it. However, if the previously poured swath (which has hardened) is being used as one of the forms 197 then it is not possible to adjust the height of the previously poured swath to compensate for the screeding process delta. To this end, various embodiments use a screed bar spacer affixed to the bottom of screed bar 107 on the side of the previously poured swath in conjunction with the form 197 being constructed slightly higher than the level of the previously poured swath.

FIG. 4 also depicts a screed bar extension 135. The cross section of the screed bar extension 135 is typically the same as the screed bar 107, with a slightly smaller cross-sectional portion that fits into the end of the screed bar 107. One or more holes 139 may be provided for bolts 141 used to secure the screed bar extension 135 to the screed bar 107. The bolts 141 pass through holes 139 and tighten into threaded holes 137.

Figure 5:
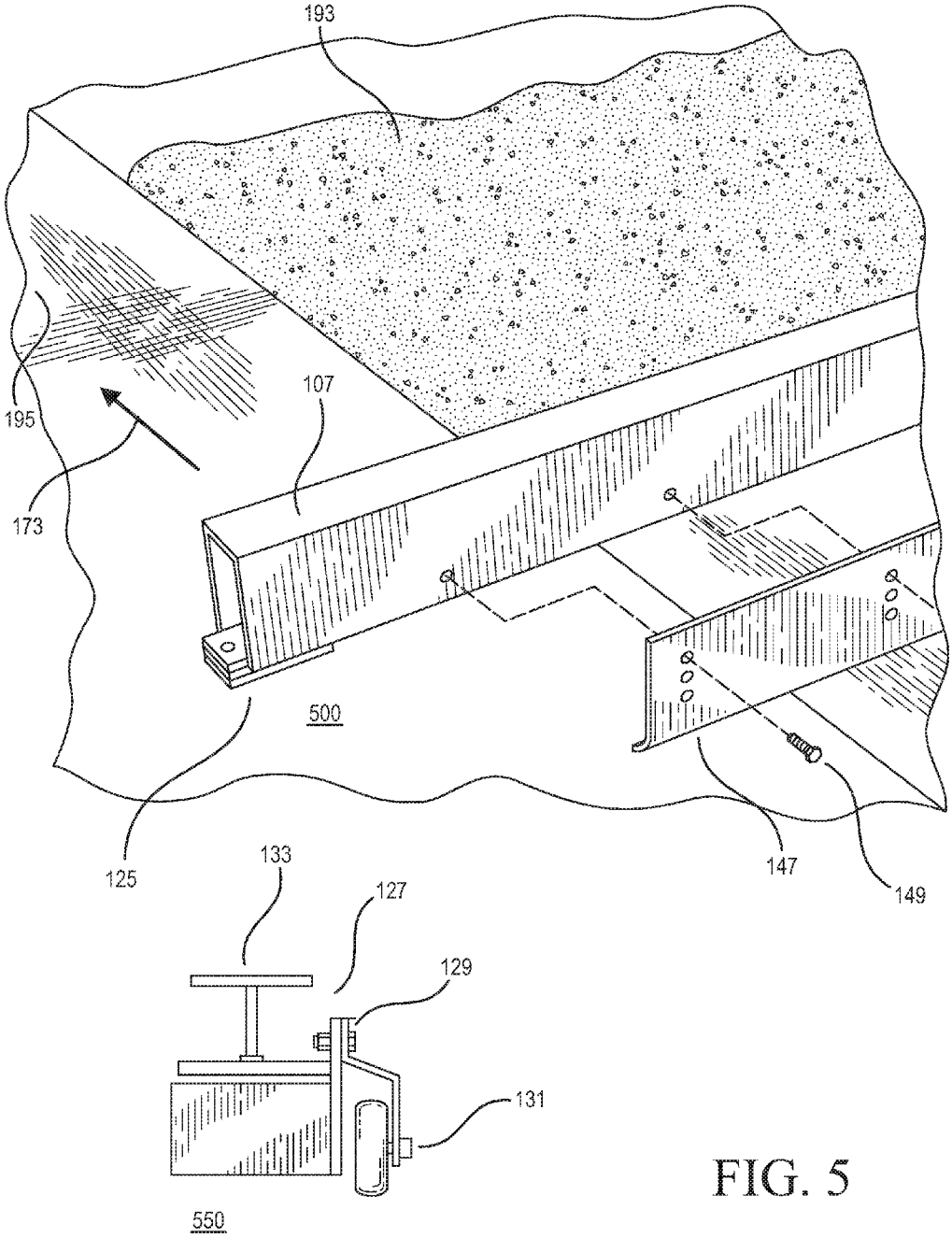
FIG. 5 depicts embodiments of an optional screed bar spacer and subgrade screeder attachments that may be affixed to the screed bar.

FIG. 5 depicts embodiments 500 and 550 of an optional screed bar spacer and subgrade screeder 147 attachments that may be affixed to the screed bar. As shown in the figure, the screed bar spacer 125 is affixed to the end of the screed bar 107 resting on a previously poured concrete surface 195 to compensate for the screeding process delta. The screed bar spacer 125 is a removable attachment with a predetermined thickness that compensates for the level of freshly screeded concrete being slightly lower than the level of the underside of the screed bar 107 due to small pebbles and gravel being pushed in front of screed bar 107 during the screeding process. A user simply taps the screed bar spacer 125 into position within the screed bar 107, and it is held in place by friction. To remove the screed bar spacer 125, the user merely taps it back out. The screed bar spacer 125 is held to the bottom side of screed bar 107 on the end that rides across the swath of previously poured, hardened concrete. Since the level of the freshly screeded concrete will be lower by a slight amount than the bottom of the screed bar 107 due to the screeding process delta, the screed bar spacer 125 allows the screed bar 107 to pass over the newly poured concrete at a level slightly higher than the desired level of the finished concrete surface to compensate for the screeding process delta. In this way, the newly screeded concrete will end up at approximately the same level as the previously poured concrete swath adjacent to it.

The wide swath offset concrete screed 100 may be provisioned with screed bar spacers 125 of various thicknesses, depending upon the anticipated amount of screeding process delta—that is, the amount that the newly poured concrete is anticipated to be lower. The anticipated amount of screeding process delta depends upon the characteristics of the wet concrete slurry such as the size of the pebbles and gravel in the wet concrete slurry, how wet the concrete slurry is, the temperature of the wet concrete slurry, etc. Since a given contractor may order wet concrete slurry many times from the same concrete supplier, the contractor will generally get a feel for the amount of screeding process delta to expect from a particular concrete provider for a given grade of concrete. A screed bar spacer 125 for use with the various embodiments may have a predetermined thickness of as little as 1/16 inch or as much as ¾ inch, or any value in between, depending upon the characteristics of the wet concrete slurry resulting in screeding process delta. A typical thickness for a slab of concrete 8 inches thick is ¼ inch. In various embodiments the bottom side of the screed bar spacer 125 is smooth with rounded corners in order to push the pebbles and gravel of the wet concrete slurry underneath it during the screeding process. This aids in preventing the pebbles and gravel from scraping along the surface of the wet concrete slurry before they pass beneath the screed bar spacer 125. In addition the screed bar spacer 125 is configured to be smooth with rounded corners aids to avoid gouging or scoring the concrete surface that it rests and slides upon.

FIG. 5 depicts another screed bar spacer embodiment—the screed bar spacer 127 which is configured with a wheel that rolls along the previously poured concrete surface 195. The screed bar spacer 127 is particularly useful when the previously poured concrete 195 has not yet hardened sufficiently to avoid scoring the surface. The screed bar spacer 127 slides into screed bar 107, and is tightened into place with a compression bolt 133. Moreover, the screed bar spacer 127 may be configured to be adjustable by providing an elongated slot either for bolt 129 or for a bolt at point 131.

FIG. 5 also depicts a subgrade screeder attachment 147. To preparing a pour site the contractor generally deposits gravel, sand or pebbles, or some other subgrade material, between the longitudinal forms 197. It is important to have a uniformly flat, level subgrade surface to pour the wet concrete slurry on, in order to ensure that the resulting concrete pad is of a uniform thickness. According to conventional methods, the subgrade material is graded and leveled by hand with shovels or rakes. These conventional methods of preparing the subgrade are quite a labor intensive and must be performed prior to pouring the concrete. It generally takes at least a couple—or even several—manual laborers working to smooth and level the subgrade material by hand, and it is nearly impossible to create a uniformly flat, level subgrade surface. The embodiments disclosed herein overcome aid in cutting down the manual labor required to prepare the subgrade materials by hand, while at the same time drastically increasing the precision of the subgrade leveling process.

The subgrade screeder attachment 147 depicted in FIG. 5 attaches to the screed bar 107 using one or more bolts 149. Alternatively, the subgrade screeder attachment 147 may be affixed to the screed bar 107 using pins, clamps, cables, chains, or other like type of structures for affixing the subgrade screeder attachment 147 in place on the screed bar 107. In other embodiments the subgrade screeder attachment 147 is attached to the screed bar 107 with a hinge mechanism so that it can be hinged upward out of the way when not in use. The depth that the subgrade screeder attachment 147 extends below the lower level of screed bar 107 is adjustable in order to equal the desired thickness of the concrete pad being poured. In the embodiment depicted in FIG. 5 there are a series of holes that allow the subgrade screeder attachment 147 to be set at various depths, thus creating concrete pads of various thicknesses. In other embodiments the subgrade screeder attachment 147 has an elongated hole, or slot, to allow adjustment up and down to create various thickness of a concrete pad.

Typically, the width of the subgrade screeder attachment 147 is slightly narrower than the width of the longitudinal forms 197, for example, one to six inches narrower. The screeder attachment 147 may be provided in multiple pieces so as to easily vary the width to accommodate the width of the longitudinal forms 197. The subgrade screeder attachment 147 is typically made of metal. Aluminum generally provides sufficient strength, and is advantageously lightweight. However, other implementations of the subgrade screeder attachment 147 may be made of iron, steel, or other like metals. In some embodiments the lower edge of the subgrade screeder attachment 147 may be curved slightly in the direction of screeding movement 173. The slight curve tends to cut into the loose gravel, sand or pebbles typically used as subgrade material, thus pulling the subgrade screeder attachment 147 slightly downward to create a smooth, level subgrade surface. In various embodiments the curved portion of the lower edge of the subgrade screeder attachment 147 is angled from as little as 15 degrees to as much as 90 degrees, relative to vertical. In other embodiments the lower edge of the subgrade screeder attachment 147 is squared off straight, rather than having a slight curve as shown in FIG. 5.

Figure 6:
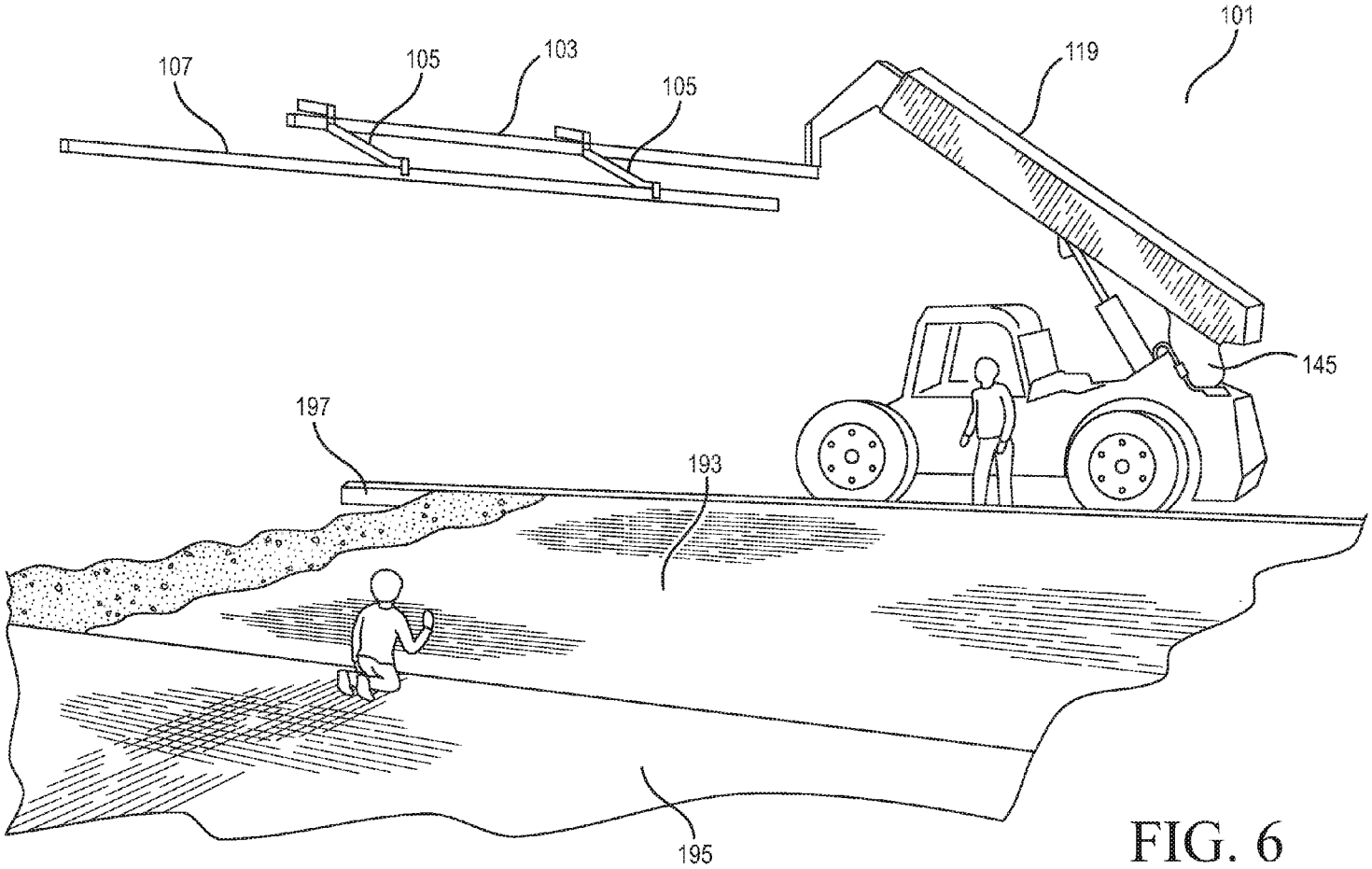
FIG. 6 depicts the wide swath offset concrete screed being raised.

FIG. 6 depicts the wide swath offset concrete screed 100 in a raised position. In some instances the area just outside the forms and just beyond the end of the swath of concrete being poured may have an obstacle such as a fence or building, or otherwise be inaccessible. When this occurs it may not be possible to drive the motorized vehicle 101 very far beyond the end of the swath of concrete. In such situations it is useful to be able to lift the concrete screed 100 high enough to permit a concrete truck to back up close enough to unload the wet concrete beneath the raised screed. Various embodiments of the concrete screed 100 can be raise high enough to permit wet concrete to be unloaded beneath it, as shown in FIG. 6. For example, depending upon the type of motorized vehicle 101 being used, the wide swath offset concrete screed 100 can be raised to a level of fifteen feet or more. For embodiments using an extension loader as the motorized vehicle 101 as depicted in FIG. 6 the offset concrete screed 100 can be raised to over twelve feet. This is sufficient height to allow a concrete truck to back up and deliver its load of wet concrete slurry under the offset concrete screed 100. Other embodiments may raise the concrete screed 100 even higher, for example, for clearance beneath the screed bar 107 of 15 feet or even more, depending upon how far the liftable arm 119 of the motorized vehicle 101 is able to extend or rise in the air.

As the liftable arm 119 is lowered it is desirable not to slam it into the lateral forms 197. To aid in this some embodiments include a flow restrictor 145 in the hydraulic line to controllably constrict the flow of hydraulic fluid. The flow restrictor 145 tends to slow down the upward and downward movement of the liftable arm 119, making it easier for a user to ease the liftable arm 119 into position as it is raised and lowered during the screeding process.

Figure 7:
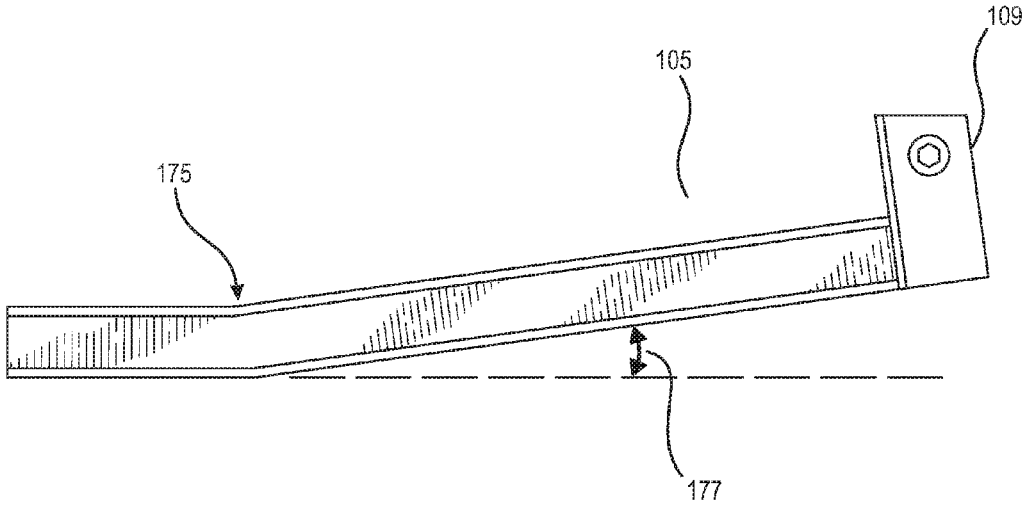
FIG. 7 depicts a lateral support bar configured to have a slight amount of curve.

FIG. 7 depicts a lateral support bar 105 configured to have a slight amount of curve at point 175. In various embodiments it is desirable for the underside of screed bar 105 to lay relatively flat on the wet concrete slurry and the longitudinal forms 197. Having the underside of screed bar 105 flat aids in keeping it from riding up over mounds of wet concrete slurry as it is pulled along, or gouging into the wet concrete. Further, the flat underside as it is drawn over the wet concrete slurry provides a smoothing effect that helps to produce a smooth, level surface of the finished concrete. At the same time it is desirable to keep the cross support bar 103 several inches above the forms 197 to keep it from catching on the forms 197 and causing perturbations in the smooth surface of the concrete.

To achieve this—having the underside of screed bar 105 flat while the cross support bar 103 passes several inches above the forms 197—various embodiments of the lateral support bars 105 are configured to have a slight amount of curve. In some embodiments the lateral support bars 105 are gradually curved along their entire length. In other embodiments, the lateral support bars 105 are curved at a particular point, for example, at point 175 as depicted in FIG. 7. In yet other embodiments, the lateral support bars 105 are angled at a particular point rather than being gradually curved (e.g., a sharp curve). In all of these embodiments the lateral support bars 105 are said to be curved by a lateral support bar curve 177. In various implementations the lateral support bar curve 177 may vary from as little as 1 degree to as much as 30 degrees, and may be any value in between these two extremes. A typical value for the lateral support bar curve 177 is 4 degrees. In some embodiments the lateral support bars 105 are approximately four feet long. However, the length may be varied depending upon the requirements of the pour and the situation in which it is to be used to be as short as one foot or as long as twelve feet. Using shorter lateral support bars 105 will result in the cross support bar 103 being positioned closer to the forms 197. Using longer lateral support bars 105 will result in more downward rotational force on the cross support bar 103 due to the increased leverage. Therefore, in various embodiments the lateral support bars 105 are generally kept within three to six feet, with four feet being a typical length embodiment.

Figure 8:
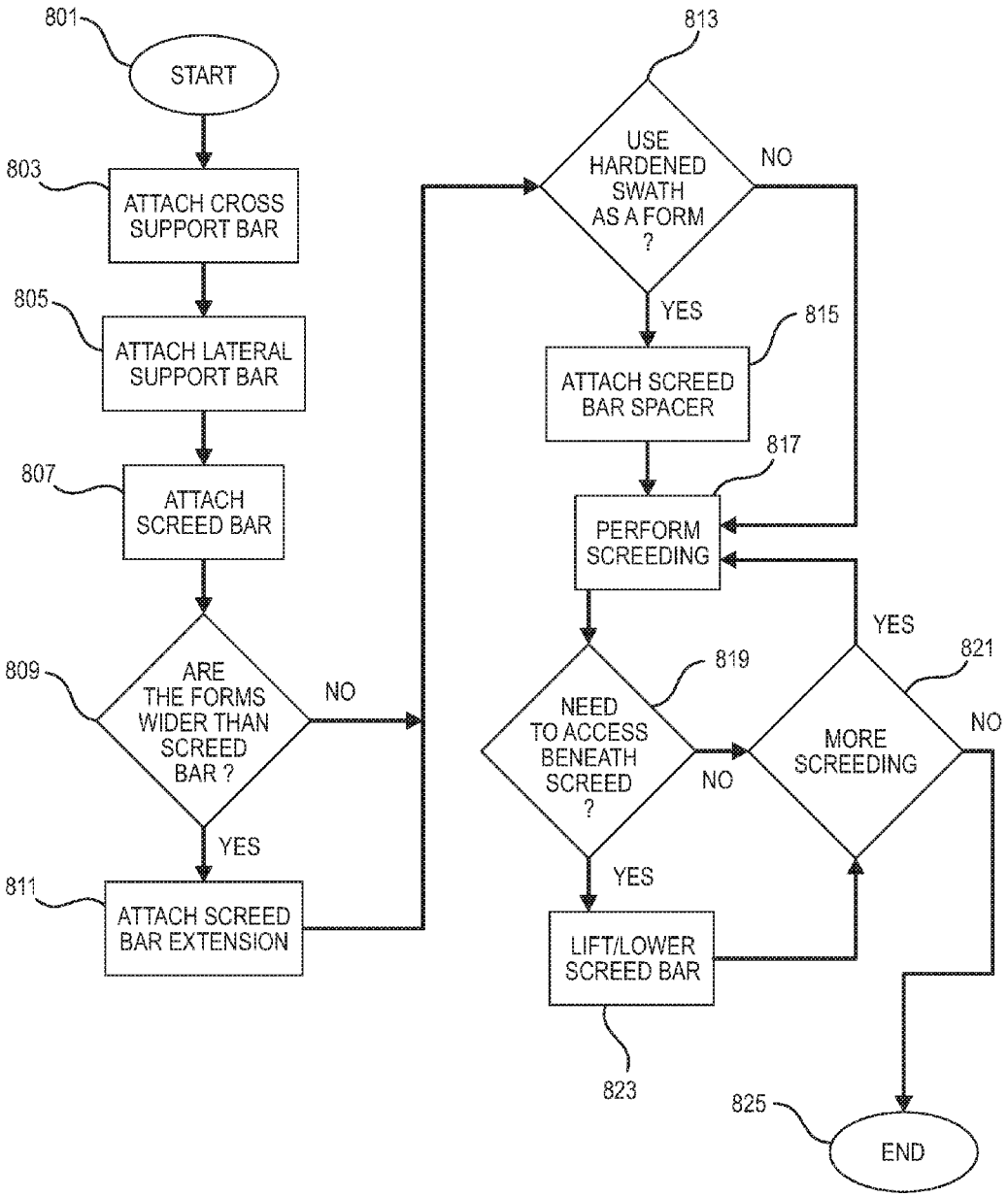
FIG. 8 is a flowchart depicting the use of the concrete screed 100 according to various embodiments of the invention.

FIG. 8 is a flowchart depicting the use of the concrete screed 100 according to various embodiments of the invention. Reference is made to the previous figures in the application, including various reference numbers shown in the figures. The method begins at block 801 and proceeds to block 803 where the user provides a cross support bar 103. The cross support bar 103 is typically connected to the liftable arm 119 of a motorized vehicle 101. The method proceeds to block 803 for attaching the lateral support bars 105 to the cross support bar 103. This is generally done using hinge assemblies 109. In some embodiments, however, the lateral support bars 105 may be fixedly connected to the cross support bar 103, with the lateral support bars 105 themselves being capable of hinging. The lateral support bars 105 typically have a slight amount of bend in them, e.g., approximately four degrees—that is, $4^{0+}/_10\%$.

In block 807 the screed bar 107 is connected to the lateral support bars 105. Typically, the screed bar 107 is fixedly attached to the lateral support bars 105. However, in some embodiments the screed bar 107 may be connected to the lateral support bars 105 in a manner that allows the screed bar 107 to have some play or movement relative to the lateral support bars 105, e.g., a hinging motion. In block 809 it is determined whether the longitudinal forms 197 are wider apart than the length of the screed bar 107. If the screed bar 107 needs to be longer, the method proceeds along the "YES" path to bock 811 for attachment of one or more screed bar extensions 135 to the screed bar 107, and then proceeds to block 813. If the screed bar 107 is of sufficient length for the configuration of longitudinal forms 197 the method proceeds from block 809 along the "NO" path to block 813.

In block 813 of FIG. 8 it is determined whether the wet concrete slurry is to be poured into forms on either side (e.g., for the first concrete swath to be poured), or a previously poured, now hardened, swath of concrete is to be used on one side of the pour in place of the longitudinal forms for that side. If previously poured swath of concrete is to be used in place of the forms it may be the case that the screeding will result in a screeding process delta in which the level of the concrete is slightly lower than the level of the forms, as discussed previously in conjunction with FIG. 5. If a screeding process delta—that is, a level of the concrete surface slightly lower than the screen bar surface—is anticipated, the method proceeds from block 813 along the "YES" path to block 815 to attach a screed bar spacer 125 or 127. However, if no screed bar spacer is desired the method proceeds from block 813 along the "NO" path to block 817.

In block 817 the user operates the motorized vehicle 101 to screed the wet concrete slurry to a desired degree of levelness. During the screeding process it is sometimes the case that the screed bar 107 needs to be raised, for example, to back the motorized vehicle 101 up or to allow a concrete truck to deliver another load of concrete. If, in block 819, it is determined that the screed bar 107 needs to be raised the method proceeds along the "YES" path to block 823 to raise the screed bar 107 (or lower it if it was previously raised). The method then proceeds to block 821 to determine whether further screeding operations need to be performed. If further screeding is to be done, the method proceeds back to block 817 along the "YES" path. However, if the screeding is completed the method proceeds from block 821 along the "NO" path to block 825 where the method ends.

Various activities of the method disclosed herein may be included or excluded as described above, or maybe performed in a different order than the particular examples chosen to illustrate the embodiments. For example, it may be the case that the screed bar extension may be attached to the screed bar (block 811) prior to attaching the screed bar to the lateral support bar (block 807). Or it may be the case that the screed bar spacer may be attached to the screed bar (block 815) prior to attaching the screed bar to the lateral support bar (block 807). The sequence of steps for performing the method of making and using a wide swath offset concrete screed according to the various embodiments disclosed herein may be altered in many other ways as well.

The description of the various embodiments provided above is illustrative in nature inasmuch as it is not intended to limit the invention, its application, or uses. Thus, variations that do not depart from the intents or purposes of the invention are intended to be encompassed by the various embodiments of the present invention. Such variations are not to be regarded as a departure from the intended scope of the present invention.

What is claimed is:

1. An offset concrete screed apparatus for screeding wet concrete slurry, comprising:

a cross support bar;

means for attaching the cross support bar of the offset concrete screed apparatus to a liftable arm of a motorized vehicle;

at least two lateral support bars attached to the cross support bar;

a screed bar attached to said at least two lateral support bars;

one or more hinge assemblies attached between the at least two lateral support bars and the cross support bar, wherein the one or more hinge assemblies prevent the at least two lateral support bars from hinging downward by more than a predetermined amount from horizontal, defined as a support bar angle, wherein the support bar angle is no less than 3 degrees and no greater than 45 degrees;

wherein the screed bar is positioned offset from the motorized vehicle allowing the motorized vehicle to be driven outside forms containing the wet concrete slurry during the screeding.

2. The offset concrete screed apparatus of claim 1, further comprising:

one or more removable screed bar sections configured to be attached to the screed bar to increase a width of the screed bar.

3. The offset concrete screed apparatus of claim 1, wherein the support bar angle is no less than 5 degrees and no greater than 25 degrees.

4. The offset concrete screed apparatus of claim 1, wherein the at least two lateral support bars have a support bar curve that is no less than 2 degrees and no greater than 15 degrees.

5. The offset concrete screed apparatus of claim 1, further comprising:

a screed bar spacer configured to be affixed to an end of the screed bar resting on a surface of a previously poured concrete swath, the previously poured concrete swath being used as one of the forms for containing the wet concrete slurry during the screeding;

wherein the screed bar spacer has a predetermined thickness to compensate for the screeding process delta.

6. The offset concrete screed apparatus of claim 5, wherein the predetermined thickness is at least ⅛ inch but no great than ⅜ inch.

7. The offset concrete screed apparatus of claim 1 for screeding the wet concrete slurry into a concrete pad of a predetermined thickness, further comprising:

a subgrade screeder attachment configured to removable attach to the screed bar;

wherein the subgrade screeder attachment extends below the underside of the screed bar by a depth equal to the predetermined thickness.

8. A method of using an offset concrete screed apparatus to screed wet concrete slurry, the method comprising:

providing a cross support bar;

attaching one or more hinge assemblies between at least two lateral support bars and the cross support bar, wherein the at least two lateral support bars have a support bar curve that is no less than 2 degrees and no greater than 15 degrees;

attaching the cross support bar of the offset concrete screed apparatus to a liftable arm of a motorized vehicle;

attaching the at least two lateral support bars to the cross support bar;

attaching a screed bar to said at least two lateral support bars;

wherein the screed bar is positioned offset from the motorized vehicle.

9. The method of claim 8, wherein positioning the screed bar offset from the motorized vehicle allows the motorized vehicle to be driven outside forms containing the wet concrete slurry during the screeding.

10. The method of claim 8, wherein the support bar curve allows an underside of the screed bar to remain flat while the cross support bar passes several inches above the forms.

11. The method of claim 10, wherein the one or more hinge assemblies prevent the at least two lateral support bars from hinging downward by more than a predetermined amount from horizontal, defined as a support bar angle; and wherein the support bar angle is no less than 5 degrees and no greater than 25 degrees.

12. The method of claim 10, further comprising:

affixing a screed bar spacer to an end of the screed bar resting on a surface of a previously poured concrete swath, the previously poured concrete swath being used as one of the forms for containing the wet concrete slurry during the screeding;

wherein the screed bar spacer has a predetermined thickness to compensate for the screeding process delta of at least ⅛ inch but no great than ⅜ inch.

13. The method of claim 8, wherein the wet concrete slurry is screeded into a concrete pad of a predetermined thickness, the method further comprising:

removably attaching a subgrade screeder attachment to the screed bar;

wherein the subgrade screeder attachment extends below the underside of the screed bar by a depth equal to the predetermined thickness.

14. The method of claim 8, wherein the lateral support bars are at least three feet long and no greater than six feet long.

15. The method of claim 8, wherein the one or more hinge assemblies prevent the at least two lateral support bars from hinging downward by more than a predetermined amount from horizontal, defined as a support bar angle; and wherein the support bar angle is no less than 3 degrees and no greater than 45 degrees.

16. The method of claim 8, further comprising:

increasing a width of the screed bar.

17. The method of claim 15, further comprising:

increasing the width of the screed bar by inserting one or more removable screed bar sections.

* * * * *